US006474760B2

(12) United States Patent
Rauls

(10) Patent No.: US 6,474,760 B2
(45) Date of Patent: Nov. 5, 2002

(54) DRAWER FOR GAMING DEVICES

(76) Inventor: Rodney Rauls, 2300 S. Lewis #78, Anaheim, CA (US) 92802

( * ) Notice: Subject to any disclaimer, the term of this patent is extended or adjusted under 35 U.S.C. 154(b) by 0 days.

(21) Appl. No.: 09/804,784

(22) Filed: Mar. 12, 2001

(65) Prior Publication Data

US 2002/0125801 A1 Sep. 12, 2002

(51) Int. Cl.[7] ..... A47B 88/20

(52) U.S. Cl. ..... 312/330.1; 108/50.01; 248/157; 312/208.1; 312/270.2

(58) Field of Search ..... 312/208.2, 208.1, 312/208.3, 237, 270.2, 270.3, 348.3, 348.5, 223.3, 223.6, 330.1; 108/13, 14, 50.01, 50.02; 248/157, 639, 676

(56) References Cited

U.S. PATENT DOCUMENTS

| | | | | | |
|---|---|---|---|---|---|
| 993,588 | A | * | 5/1911 | Donning | 312/208.1 X |
| 2,505,814 | A | | 5/1950 | Voorhorst | |
| 4,635,893 | A | | 1/1987 | Nelson | |
| 4,717,112 | A | * | 1/1988 | Pirkle | 248/157 X |
| 4,893,775 | A | | 1/1990 | Long | |
| 5,248,192 | A | * | 9/1993 | Tazzia | 312/208.1 X |
| 5,424,912 | A | | 6/1995 | Mikan | |
| 5,452,876 | A | | 9/1995 | Hatcher | |
| 5,651,524 | A | | 7/1997 | Calfee | |
| 5,735,222 | A | | 4/1998 | Webb | |
| 6,042,075 | A | | 3/2000 | Burch, Jr. | |
| 6,109,585 | A | | 8/2000 | Burch, Jr. | |
| 6,158,829 | A | * | 12/2000 | Nielson | 312/208.1 X |
| 6,241,329 | B1 | * | 6/2001 | Nielson | 108/50.02 X |

* cited by examiner

*Primary Examiner*—John G. Weiss
*Assistant Examiner*—Michael J. Fisher
(74) *Attorney, Agent, or Firm*—Trojan Law Offices

(57) ABSTRACT

A multi-function drawer for a desk that provides multiple and adjustable platforms (easel, gaming, and sliding) to mount gaming devices, a keyboard, books, papers, or other objects in use at a desk or workstation. These separate and rotatably platforms allow several items to be attached to a drawer for use at the same time and multiple positions for the platforms to maximize a desk or workspace.

13 Claims, 3 Drawing Sheets

DRAWER FOR GAMING DEVICES

BACKGROUND OF THE INVENTION

1. Field of the Invention

A drawer for mounting and storing gaming devices, a keyboard, or books at a computer desk or workstation.

2. Description of Related Art

With the popularity of the personal computer not only at the workplace but also the home, the desk of a user has become increasingly crowded. The user not only needs space for books, papers, lights, pens, and other stationary items, but the user also needs a large amount of space for the computer. Even when the computer is stored to the side or under the desk, the monitor and keyboard can take up a large amount of space directly in front of the user. In addition, users may also have other computer devices and peripherals such as a gaming controller, joystick, or steering wheel to be used with the computer. As a result of this need to efficiently use space on a modern desktop area, there remains a need to store many of these items in a limited workspace. But, at the same time, the user requires that these different computer devices and desk items be readily available for use.

Currently, there are many desks that provide a drawer that houses a keyboard, and there are some desks that provide another space on the same plane as the keyboard for a gaming device. But, none of these related art devices provide separate rotating and pivoting platforms to mount a keyboard, a gaming device, and books/papers all on the same drawer assembly. There remains a need by the user to mount both a keyboard, a book or a paper, and a gaming device (steering wheel or a joystick or some type of controlling device) within the confined space of a computer desk or workstation. From the preceding descriptions, it is apparent that the devices currently being used have significant disadvantages, and important aspects of the technology used in the field of invention remain amenable to useful refinement.

SUMMARY OF THE INVENTION

The purpose of the present invention is to provide a multi-surfaced and multi-function drawer for installation in a desk that allows for the simultaneous mounting and storage of a gaming device and/or a keyboard.

Another purpose of the present invention is to provide one drawer that provides several different options to hold a gaming device, a keyboard, and books or papers at the same workstation or in a limited space desktop area.

Another purpose of the present invention is to provide a multi-function drawer for installation in a desk that enables easy mounting of a gaming device and still have use of a keyboard and an easel to hold a book or a keyboard.

Another purpose is to provide mounting places for several computer devices in a limited space and without sacrificing monitor viewing space.

This invention allows for a multi-function drawer with three basic positions: (1) the easel platform closed and the gaming device underneath; (2) the easel platform opened and the gaming device shifted forward such that a keyboard or book can be placed on the easel platform; (3) the easel platform open to hold a book or keyboard with the gaming device underneath, and the sliding platform when extended forward to hold a keyboard.

The advantages of this claimed invention allow for maximizing the limited space on and about a desk and enables use of both a keyboard and a gaming device simultaneously. The easel, gaming, and sliding platforms are easy to use and provide quick adjustment from workstation with keyboard and/or book to gaming console position. This invention also does not block the screen of the monitor, and the easel can support a full sized book, a three ring binder, or a keyboard when the gaming platform is extended forward. This invention allows for storage of the gaming device (underneath) to avoid taking up valuable desktop space.

Another advantage of this invention is not having to connect and disconnect the gaming device before or after use. Normally, a gaming device is temporarily attached to a surface, but with this invention, the gaming device can be bolted and securely fastened to the gaming platform for the user's convenience and ease of use. As a result, the user can have easy access to not only a gaming device when needed but any computer desk related device in one compact and easy to use drawer.

The present invention introduces such refinements. In its preferred embodiments, the present invention has several aspects that can be used independently, although they are preferably employed together to optimize their benefits. All of the foregoing operational principles and advantages of the present invention will be more fully appreciated upon consideration of the following detailed description, with reference to the appended drawings.

DESCRIPTION OF THE PREFERRED EMBODIMENTS

This present invention combines three different platforms or mounting surfaces for a drawer to enable holding, mounting, and storage of gaming devices, a keyboard, and books or papers. There are three platforms: an easel platform, a gaming platform, and a sliding platform. A gaming device such as a joystick or a steering wheel control unit can be fixably mounted to the gaming platform. When the user does not need the gaming device and requires use of the computer keyboard, the user can easily swing the gaming platform from the active or operating position to the storage position by releasing the clasps and swinging the gaming platform backward and underneath the drawer assembly and relatching.

The easel platform and the gaming platform are rotatably and pivotally mounted to the drawer assembly, so that each can be rotated into use or back into storage. The sliding platform is located within a brace and just below the top surface of this brace. With these three platforms, the present invention provides multiple different positions of operation to allow the user to maximize a limited space environment.

Figure 1:
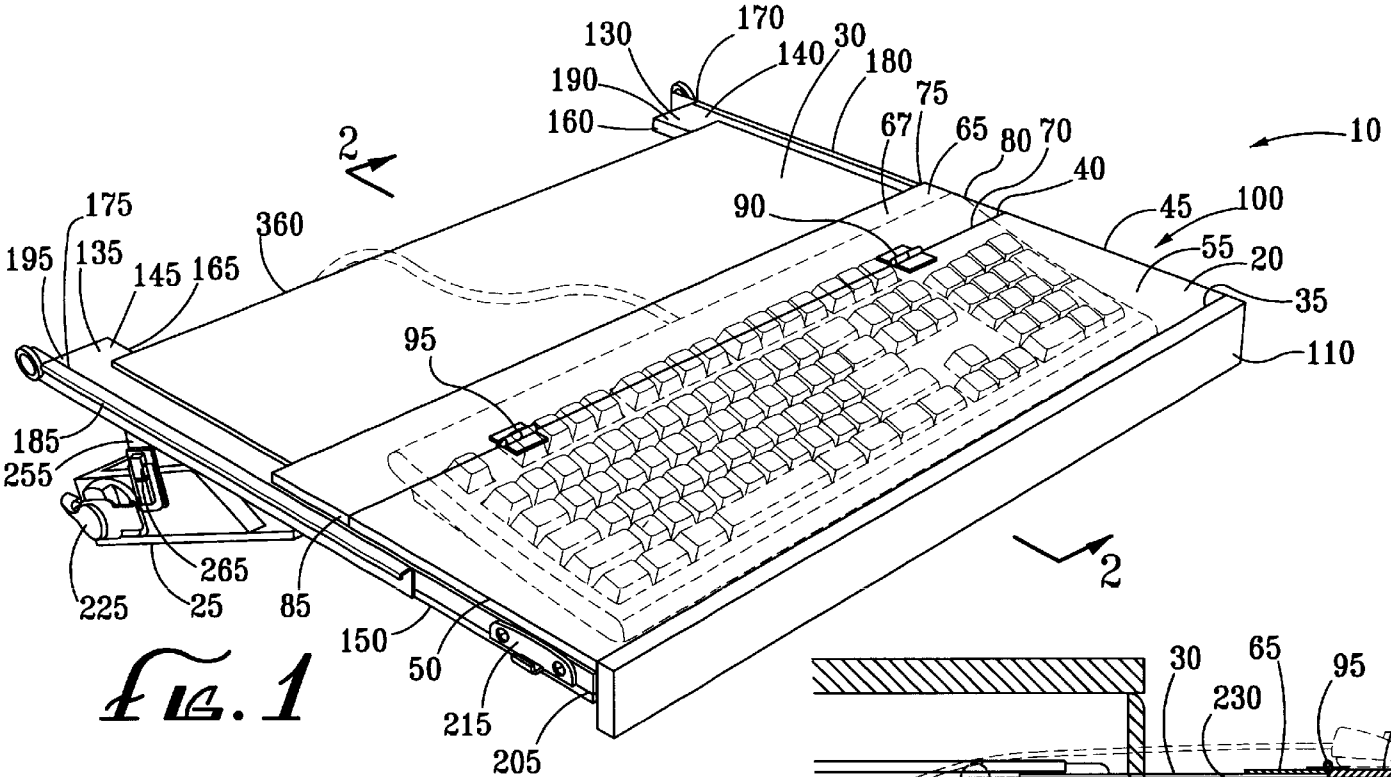
FIG. 1 is view of the closed gaming drawer with a keyboard.
Figure 2:
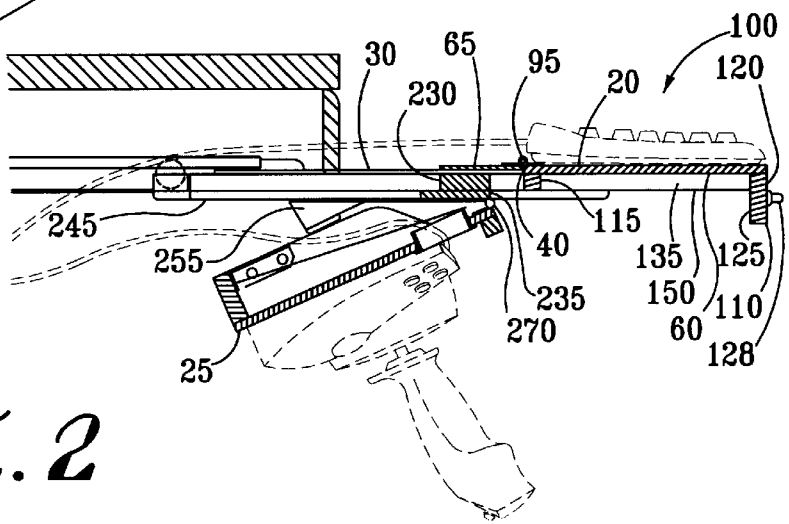
FIG. 2 is a side view of FIG. 1 that has the gaming device mounted in the storage position or with the easel platform closed and the gaming device underneath and mounted to the gaming platform.

As shown in FIGS. 1–6, there is provided a drawer assembly 10 for gaming devices 15 with three platforms: an easel platform 20, a gaming platform 25, and a sliding platform 30. The easel platform 20 has an outer easel edge 35 and an inner easel edge 40. Also, as shown in FIG. 1, the easel platform 20 also has two rail easel sides 45, 50, a top easel surface 55, and a bottom easel surface 60.

Located adjacent and parallel to the inner easel edge 40, there is a brace having a top brace surface, a bottom brace surface, a first brace edge, a second brace edge, and two brace rail sides. In the embodiment shown in FIGS. 1–6, there is an upper brace 65, which has a top brace surface 67, a first upper brace edge 70, a second upper brace edge 75, and two upper brace rail sides 80, 85. As shown in FIG. 1, these two rail brace sides 80, 85 are parallel to the rail easel sides 45, 50.

Figures 3, 4:
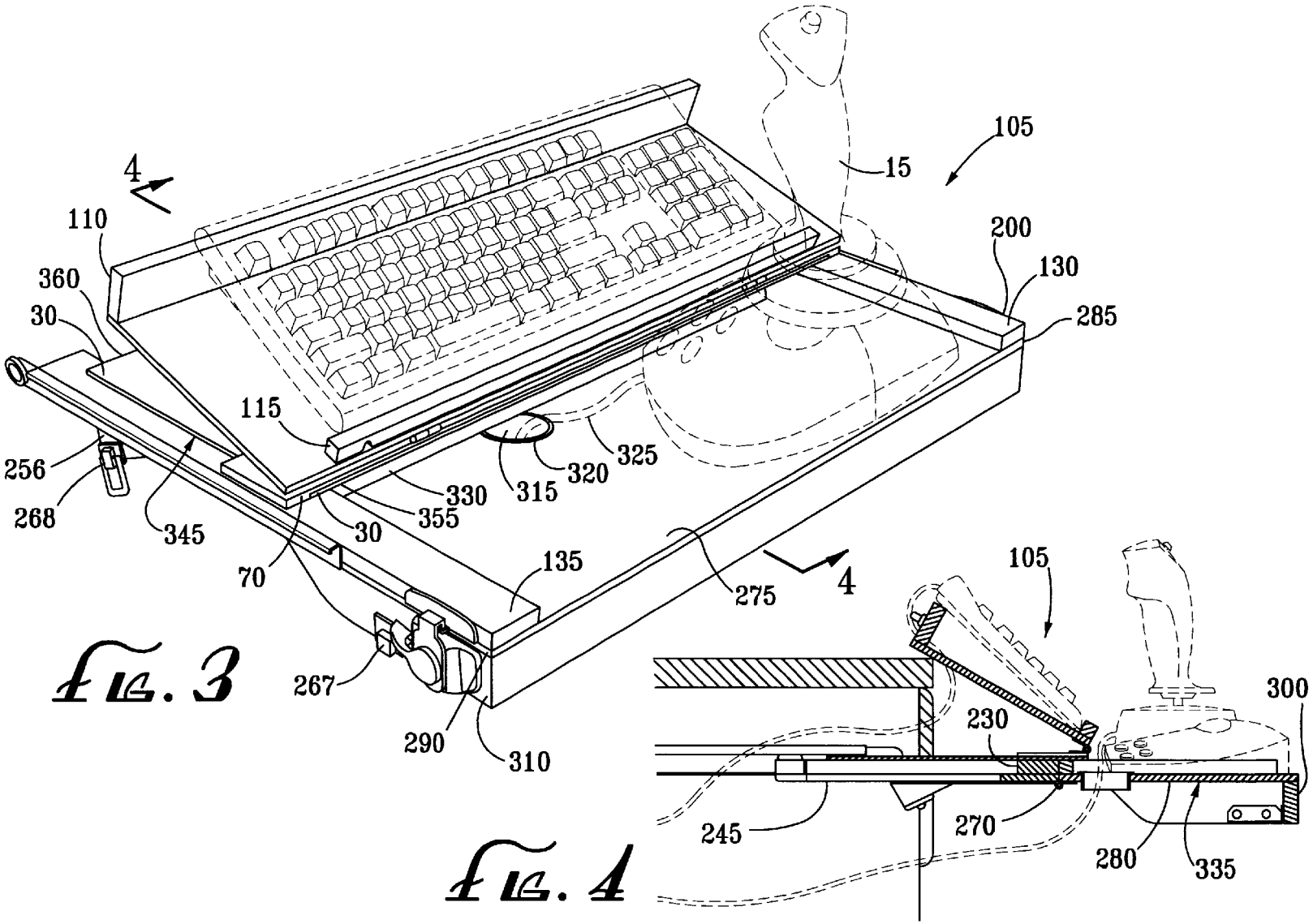
FIG. 3 is a view of the gaming drawer with the easel platform opened and holding a keyboard and the gaming platform forward in its operating position with the gaming device ready to use.
FIG. 4 is a side view of FIG. 2 with the gaming drawer with a keyboard and a gaming device with the easel platform opened and the gaming platform shifted forward.

The easel platform 20 is rotatably and pivotally connected to the upper brace with at least one pivoting attachment, such as a hinge 90. In FIG. 1, there are two hinges 90, 95 that secure the top easel surface 55 to the top upper brace surface 67. This hinge connection allows the easel platform 20 to be lifted up and backward from a first closed position 100 (FIGS. 1 and 2) to a second open position 105 (FIGS. 3 and 4).

The easel platform also has a first ledge 110 and a second ledge 115. The first ledge 110, which has an outer ledge surface 120 and an inner ledge surface 125, is attached to the bottom easel surface 60, extends perpendicularly from the bottom easel surface, and is located proximal and parallel to the outer easel edge 35. This first ledge 110 forms a lip extending perpendicularly from the bottom easel surface.

The second ledge 115 is attached to the bottom easel surface 60 and is located proximal and parallel to the inner easel edge 40. In FIG. 3, the second ledge 115 is shorter in length than the first ledge 110. The easel platform may also have a handle 128.

In FIGS. 1–6, the upper brace lies perpendicularly on two rail supports 130, 135, which slidably engage a desk or a table. These rail supports are located underneath the ends of the upper brace and are perpendicular to the upper brace and parallel with the rail easel sides 45, 50. Each rail support 130, 135 has an upper surface 140, 145, a lower surface 150, 155, a non-clasp side 160, 165, and a clasp side 170, 175. In FIGS. 1–6, these rail supports 130, 135 are located below the upper brace 65. In other embodiments, the rail supports are simply perpendicular to the brace.

Along the clasp sides 170, 175 of each rail support 130, 135 are drawer guides 180, 185, which enable a rolling connection with any standard drawer mount for slidably engaging with a desk or table. Any size drawer guide can be used for the applicant's invention. In the embodiment shown in FIGS. 1, 3, and 5, these drawer guides are placed from the distal ends 190, 195 of the rail supports to a point before the proximal ends 200, 205 of the rail supports.

Located under the upper brace 65, there is a middle brace 230, which is at approximately the same height as the rail supports 130, 135. The middle brace 230 is approximately perpendicular to the rail supports 130, 135 and provides structural support and stability to the drawer assembly. The middle brace 230 is shorter in length than the upper brace 65; for width, the upper brace 65 almost completely overlaps the middle brace 230.

Located under the middle brace 230, there is a lower brace 235. The three braces (upper 65, middle 230, and lower 235) are fixedly attached to each other by any secure attachment such as screws, glue, or staples and are placed in a tiered fashion such that the upper brace 65 is the farthest forward, then the middle brace 230, and then the lower brace 235. These tiers allow the gaming platform 20 to properly sit when moved to its operating or active position. The lower brace 235 is located at the same height as the lower rail supports 245, which lie underneath each rail support. When the gaming platform 25 is swung to its operating position, the gaming platform 25, the lower rail supports 245, and the lower brace 235 all exist substantially in the same parallel planes and height.

Also, these three braces (upper 65, middle 230, and lower 235) can all be constructed of a single piece of metal, wood, or molded material. The rail supports and even the lower rail supports can also be constructed with the three braces into a single piece of metal, wood, or molded material.

Located on each of the lower rail supports 245 are mounts 255 for locking connections, such as latches or snap clasps 265. On the outer surface 256 of these mounts 255, there are locking connections. These mounts generally enable the gaming platform to be stored and clamped at an angle. The embodiments shown in FIGS. 1–6 show the mount in a triangular shape that better enables the securing of the gaming platform at a suitable angle.

Any easy to unlatch connection device or locking connection can be used such as a latch or snap clasp to secure the gaming platform in its storage position. In FIG. 3, the snap clasp has a grip part 267 and a clasp 268. The grip part 267 is located on the gaming platform 25; the clasp 268 is located on the outer surface 256 of the snap mounts 255. These grip parts and clasps can be interchangeably mounted to either the gaming platform 25 or the rail supports 130, 135 or lower rail supports 240, 245.

The gaming platform 20 is pivotally attached to the bottom of the brace. In FIGS. 1–6, the gaming platform 25 is pivotally connected to the lower brace 235 with a pivoting attachment such as a hinge 270. The gaming platform 25 and the easel platform 20 can have more than one hinge to pivotally connect with the drawer assembly 10. Also, the gaming platform and the easel platform can be pivotally attached to the brace with any pivoting attachment such as a long hinge, multiple hinges, or a pivoting attachment using a dowel and indentations. These pivoting attachments allow the gaming platform to be extended from a storage position to an operating position.

In FIGS. 3–4, the gaming platform 25 has a top surface 275, a bottom surface 280, and two gaming platform sides 285, 290. On the bottom surface 280 and at the front of the gaming platform 25, there is a front ledge piece 300 and two side ledge pieces 310. In FIGS. 3–4, a side ledge piece 310 is placed at each end of the gaming platform. The gaming platform 25 also has a hole 315 and a grommet 320 so that a cable 325 for the gaming device 15 can be safely stowed out of the way of the gaming platform 25 and drawer assembly 10. In FIGS. 2, 3, 4, and 6, there is a gaming back ledge 330 that is located at the rear of the gaming platform 25 that provides support to the gaming platform 25 when the gaming platform 25 is raised to its operating position 335 from its storage position 340.

Also located on the clasp sides 170, 175 of each rail support 130, 135 are another set of locking connections, such as latches or snap latches. These latches are comprised of latch grips 215, which are placed closer to the proximal ends 200, 205 of the rail supports 130, 135, and latch clasps 225. These latch grips 215 are located such that these grips

Figures 5, 6:
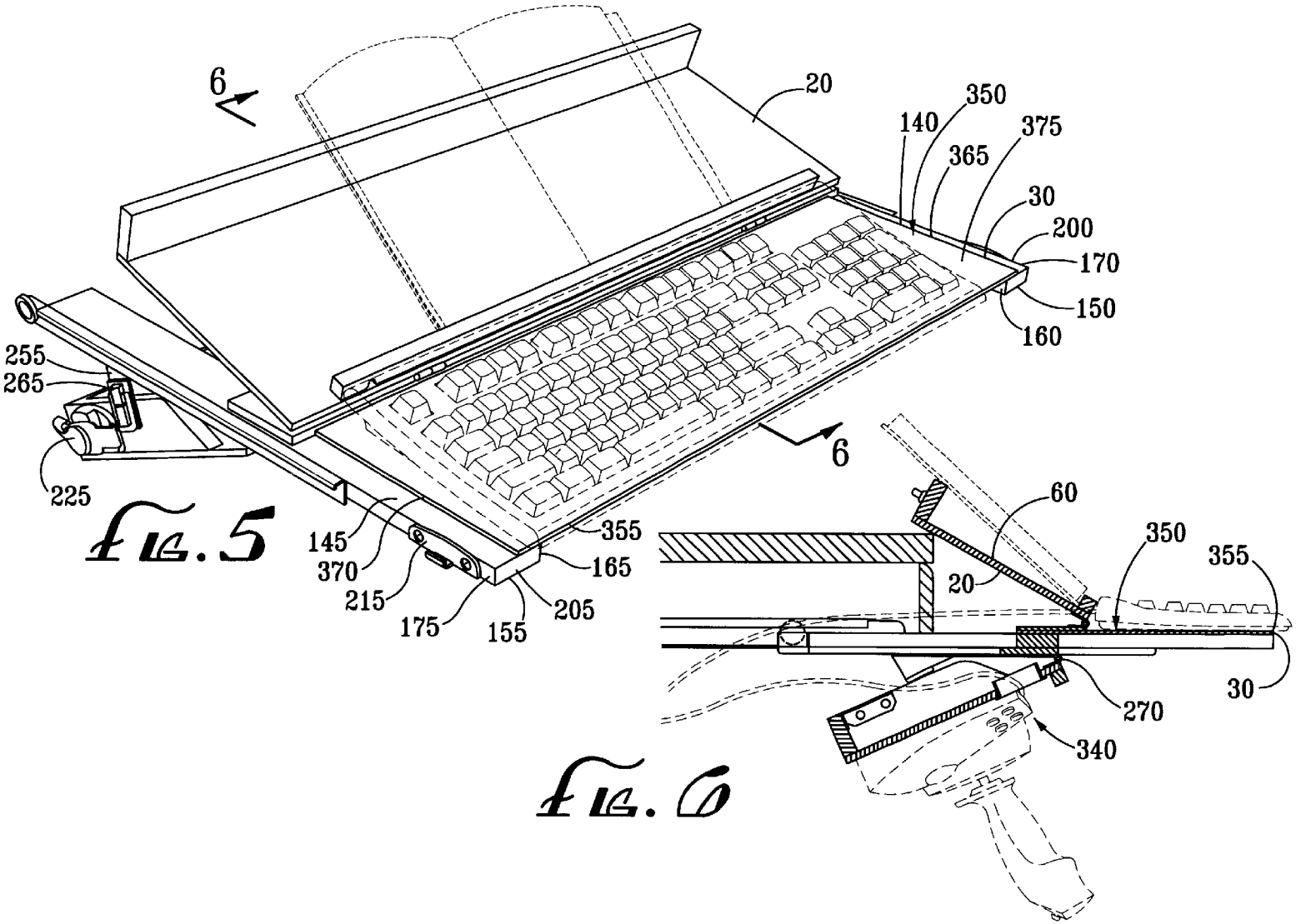
FIG. 5 is a view of the invention with the easel platform open; the gaming platform stored underneath and the sliding platform when extended forward; and, FIG. 6 is a side view of the invention in FIG. 5.

215 will coincide with the latch clasps 225 located on the gaming platform 25; the latch clasp 225 engages the corresponding latch grip 215 on the clasp side 175 of the rail support 135. FIGS. 1, 3, and 5 show the clasp 225 and the grip 267 on the side ledge piece 310 of the gaming platform.

Any type of locking connection that allows for a stable and secure hold on the platform but at the same time, allows for easy removal and access to the platform. Also, for these locking connections, the latch clasps and grips can be interchangeably mounted on either the rail support, mount, or gaming platform.

A sliding platform 30 is located within the brace. As shown in FIGS. 1–6, the sliding platform 30 is located in between the middle brace 230 and within the area of the upper brace 65, but lower than the top upper brace surface 67. This sliding platform 30 passes through the upper brace 65 and partially lies on top of the rail supports 130, 135. This sliding platform 30 also has a first position 345, a second position 350, a proximal platform end 355, and a distal platform end 360. In FIGS. 1 and 3, in the first position 345, the sliding platform 30 is slid as far toward the distal ends 190, 195 of the rail supports, so that the proximal platform end 355 is approximately flush against the first upper brace edge 70.

In FIGS. 5 and 6, in the second position 350, the proximal platform end 355 is pushed toward the proximal ends 200, 205 of the rail supports, and when the easel platform 20 is placed in its second opened position 105, the user can pull the proximal platform end 355 forward and toward the user. In FIG. 5, the sides 365, 370 of the sliding platform partially overlap the rail supports 130, 135. This overlap over the rail supports 130, 135 provides added support to the sliding platform 30 during use. In another embodiment, the sliding platform 30 can be located in different areas of the brace, such as the same level as the middle brace. In another embodiment, this sliding platform 30 may slide against the rail supports 130, 135 so that there is no overlap of the sliding platform 30 over the rail supports 135.

Once the sliding platform 30 is pulled all the way forward so that the proximal platform end 355 is approximately flush with the proximal ends of the rail supports, 200, 205, the user can place any desired object on the top surface 375 of the sliding platform 30, such as a keyboard, a computer drawing tablet, or a computer peripheral device. In FIGS. 5 and 6, with the gaming platform in its storage position and out of the way, the user can freely place books or papers on the easel and pull out the sliding platform to support a keyboard.

Thus, the user can easily and quickly transform the work area into an gaming area or a study area or visa-versa by simply sliding or rotating the different platforms. This entire drawer assembly can be placed in a desk, table, or work station. With the easel platform closed and the gaming device underneath, the user can place a keyboard on the top surface of the easel.

When the gaming device is needed, the user raises the easel platform and unlatches the gaming platform from the first locking connection. Then, the user extends the platform forward and secures the platform to the second locking connection mounted on the rail supports or lower rail supports. The keyboard can then be placed on the easel for use in conjunction with the gaming device.

When finished with the gaming device, the user simply unlocks and pushes the platform backward to secure the gaming platform to its storage position. With the easel platform still in the second opened position, the user can slide the sliding platform forward into its second position. The sliding platform can then hold a keyboard or other computer device, and the opened easel platform can support books and papers.

While the invention will be described in connection with preferred embodiments, it will be understood that it is not intended to limit the invention to those embodiments. On the contrary, it is intended to cover all alternatives, modifications, and equivalents as may be included within the spirit and scope of the invention as defined by the appended claims.

I claim:

1. A multi-function drawer for installation in a desk comprising:

an easel platform, having an outer easel edge, an inner easel edge, a top easel surface, and a bottom easel surface;

a gaming platform, having a top gaming surface, a bottom gaming surface, and an outer gaming side;

at least one brace located adjacent and parallel to the inner easel edge and having a top brace surface, a bottom brace surface, a first brace edge, a second brace edge, and two brace rail sides;

said easel platform is pivotally connected to the top brace surface with at least one pivoting attachment, which allows the easel platform to be lifted up and backward from a first closed position to a second open position;

said gaming platform is pivotally connected to the bottom surface of the brace with at least one pivoting attachment, which allows the gaming platform to be extended forward from a storage position to an operating position;

said gaming platform having multiple locking connections; and two rail supports for slidably engaging the desk, said rail supports having a non-clasp side and a clasp side said locking connections each comprising a latch grip and a latch clasp;

at least one latch grip is located on the clasp side of each rail support and near the proximal end of the rail support; and at least one latch clasp is located on the gaming platform such that said latch clasp engages the corresponding latch grip on the clasp side of the rail support.

2. The multi-function drawer of claim 1 wherein a lower rail support lies underneath each rail support;

said lower rail support has a mount approximately located near the distal end of the rail support;

said mount having an outer side, which has at least one latch clasp; at least one latch grip is located on the gaming platform such that said latch clasp engages the corresponding latch grip on the gaming platform.

3. A multi-function drawer for installation in a desk comprising:

an easel platform, having an outer easel edge, an inner easel edge, a top easel surface, and a bottom easel surface;

a gaming platform, having a top gaming surface, a bottom gaming surface, and an outer gaming side;

at least one brace located adjacent and parallel to the inner easel edge and having a top brace surface, a bottom brace surface, a first brace edge, a second brace edge, and two brace rail sides;

said easel platform is pivotally connected to the top brace surface with at least one pivoting attachment, which allows the easel platform to be lifted up and backward from a first closed position to a second open position;

said gaming platform is pivotally connected to the bottom surface of the brace with at least one pivoting attachment, which allows the gaming platform to be extended forward from a storage position to an operating position;

said gaming platform having multiple locking connections; and two rail supports for slidably engaging the desk, said rail supports having a non-clasp side and a clasp side;

said brace is an upper brace;

a middle brace is located under the upper brace, at approximately the same height as the rail supports and approximately perpendicular to the rail supports; and the middle brace is shorter in length than the upper brace, which almost completely overlaps the middle brace in width.

4. The multi-function drawer of claim 3 wherein a lower brace is located under the middle brace; and the upper, middle, and lower braces are fixedly attached to each other by secure attachments and are placed in a tiered fashion such that the upper brace is the farthest forward, followed by the middle brace, and then followed by the lower brace.

5. The multi-function drawer of claim 3 wherein the drawer assembly further comprises a sliding platform located within the brace; the sliding platform has a first position, a second position, a proximal platform end, and a distal platform end;

in the first position, the sliding platform is slid as far toward the distal ends of the rail supports, so that the proximal platform end is flush against the first brace edge; and in the second position, when the easel platform is placed in the second opened position, the proximal platform end extends forward and toward the user.

6. A multi-function drawer for installation in a desk comprising:

an easel platform, having an outer easel edge, an inner easel edge, a top easel surface, and a bottom easel surface;

a gaming platform, having a top gaming surface, a bottom gaming surface, and an outer gaming side;

at least one brace located adjacent and parallel to the inner easel edge and having a top brace surface, a bottom brace surface, a first brace edge, a second brace edge, and two brace rail sides;

said easel platform is pivotally connected to the top brace surface with at least one pivoting attachment, which allows the easel platform to be lifted up and backward from a first closed position to a second open position;

said gaming platform is pivotally connected to the bottom surface of the brace with at least one pivoting attachment, which allows the gaming platform to be extended forward from a storage position to an operating position, said gaming platform having multiple locking connections; and two rail supports, which slidably engage the desk, have a non-clasp side and a clasp side; and a sliding platform located in the brace.

7. The multi-function drawer of claim 6 wherein the pivoting attachment is a hinge;

said easel platform has two rail easel sides, a first ledge and a second ledge; the first ledge is located proximal and parallel to the outer easel edge and forms a lip extending perpendicularly from the bottom easel surface; the second ledge is attached to the bottom easel surface and is located proximal and parallel to the inner easel edge; and the second ledge is shorter in length than the first ledge;

said gaming platform has two gaming platform sides, a front ledge piece, and two side ledge pieces; said gaming platform having a hole and a grommet on the surface of the gaming platform; a gaming back ledge located at the rear of the gaming platform; and said rail supports have drawer guides, which slidably engage the desk, and proximal ends and distal ends; and the drawer guides are placed from the distal end of the rail support to a point before the proximal end of the rail support.

8. The multi-function drawer of claim 7 wherein the sliding platform has a first position, a second position, a proximal platform end, and a distal platform end;

in the first position, the sliding platform is slid as far toward the distal ends of the rail supports, so that the proximal end of the sliding platform is flush against the first brace edge;

in the second position, when the easel platform is placed in the second opened position, and the proximal end of the sliding platform extends forward and toward the user.

9. The multi-function drawer of claim 6 wherein the brace is an upper brace;

a middle brace is located under the upper brace, at approximately the same height as the rail supports and approximately perpendicular to the rail supports; and the middle brace is shorter in length than the upper brace, which almost completely overlaps the middle brace in width;

a lower brace is located under the middle brace; and the upper, middle, and lower braces are fixedly attached to each other by secure attachments and are placed in a tiered fashion such that the upper brace is the farthest forward, followed by the middle brace, and then followed by the lower brace.

10. The multi-function drawer of claim 6 wherein the locking connection comprises a latch grip and a latch clasp;

at least one first latch grip is located on the clasp side of each rail support and near the proximal end of the rail support;

at least one first latch clasp is located on the gaming platform such that said first latch clasp engages the corresponding first latch grip on the clasp side of the rail support;

a lower rail support lies underneath each rail support;

said lower rail support has a mount approximately located near the distal end of the rail support;

said mount having an outer side, which has at least one second latch clasp;

at least one latch grip is located on the gaming platform such that said second latch clasp engages the corresponding second latch grip on the gaming platform.

11. A desk including a multi-function drawer for installation comprising:

an easel platform, having an outer easel edge, an inner easel edge, and a top easel surface, a bottom easel surface;

a gaming platform, having a top gaming surface, a bottom gaming surface, and an outer gaming side;

at least one brace located adjacent and parallel to the inner easel edge and having a top brace surface, a bottom brace surface, a first brace edge, a second brace edge, and two brace rail sides;

said easel platform is pivotally connected to the top brace surface with at least one pivoting attachment, which allows the easel platform to be lifted up and backward from a first closed position to a second open position;

said gaming platform is pivotally connected to the bottom surface of the brace with at least one pivoting attachment, which allows the gaming platform to be extended forward from a storage position to an operating position;

said gaming platform having multiple locking connections; and two rail supports, which slidably engage the drawer with the desk, have a non-clasp side and a clasp side said brace is an upper brace;

a middle brace is located under the upper brace, at approximately the same height as the rail supports and approximately perpendicular to the rail supports; and the middle brace is shorter in length than the upper brace, which almost completely overlaps the middle brace in width;

a lower brace is located under the middle brace; and the upper, middle, and lower braces are fixedly attached to each other by secure attachments and are placed in a tiered fashion such that the upper brace is the farthest forward, followed by the middle brace, and then followed by the lower brace.

12. The desk of claim 11 wherein the locking connection comprises a latch grip and a latch clasp;

at least one first latch grip is located on the clasp side of each rail support and near the proximal end of the rail support;

at least one first latch clasp is located on the gaming platform such that said first latch clasp engages the corresponding first latch grip on the clasp side of the rail support;

a lower rail support lies underneath each rail support;

said lower rail support has a mount approximately located near the distal end of the rail support;

said mount having an outer side, which has at least one second latch clasp; and at least one second latch grip is located on the gaming platform such that said second latch clasp engages the corresponding second latch grip on the gaming platform.

13. The desk of claim 11 wherein the drawer assembly further comprises a sliding platform located within the brace;

the sliding platform has a first position, a second position, a proximal platform end, and a distal platform end;

in the first position, the sliding platform is slid as far toward the distal ends of the rail supports, so that the proximal platform end is flush against the first brace edge;

in the second position, when the easel platform is placed in the second opened position, the proximal platform end extends forward and toward the user; and the sides of the sliding platform partially overlap the rail supports.

* * * * *